US006152193A

United States Patent [19]

Klamm

[11] Patent Number: 6,152,193

[45] Date of Patent: Nov. 28, 2000

[54] APPARATUS AND METHOD FOR FILLING A MOTOR VEHICLE COOLING SYSTEM WITH COOLANT

[75] Inventor: Thomas L. Klamm, Racine, Wis.

[73] Assignee: UView Ultraviolet Systems, Inc., Mississauga, Canada

[21] Appl. No.: 09/496,908

[22] Filed: Feb. 2, 2000

Related U.S. Application Data

[60] Provisional application No. 60/119,961, Feb. 12, 1999.

[51] Int. Cl.[7] ..... B65B 1/04; B65B 3/04; B67C 3/02

[52] U.S. Cl. ..... 141/98; 141/61; 141/65; 141/95; 141/326; 141/382; 220/237; 138/90

[58] Field of Search ..... 141/94–96, 98, 141/311 R, 325, 326, 346, 348, 349, 363, 382, 383, 391, DIG. 2, 59, 61, 65, 83; 220/237; 138/90, 93, 96 T; 73/52

[56] References Cited

U.S. PATENT DOCUMENTS

| | | | |
|---|---|---|---|
| 2,855,003 | 10/1958 | Thaxton | 138/90 |
| 3,054,427 | 9/1962 | Bonnette | 138/90 |
| 4,298,040 | 11/1981 | Pohan | 141/115 |
| 5,573,045 | 11/1996 | Akazawa | 141/92 |
| 5,649,574 | 7/1997 | Turcotte et al. | 141/67 |

*Primary Examiner*—Henry J. Recla
*Assistant Examiner*—Timothy L. Maust
*Attorney, Agent, or Firm*—Bell, Boyd & Lloyd LLC

[57] ABSTRACT

An apparatus for adding coolant to a cooling system of a motor vehicle includes a cap with a resilient sleeve that expands against the inside wall of a radiator filler neck to provide an air-tight connection. A valve attached to the cap controls the flow of air and coolant through the cap. A gauge on the cap indicates the pressure inside the radiator. A venturi assembly connected to the valve provides a source of vacuum for evacuating air from the cooling system. Thereafter, coolant is drawn through the cap by the vacuum created in the system.

9 Claims, 1 Drawing Sheet

APPARATUS AND METHOD FOR FILLING A MOTOR VEHICLE COOLING SYSTEM WITH COOLANT

This application claims benefit of U.S. Provisional Patent Application no. 60/119,961 filed Feb. 12, 1999.

BACKGROUND OF THE INVENTION

The present invention relates to apparatus for testing and filling a cooling system of a motor vehicle with coolant.

Periodically, it is necessary to replace the coolant in the cooling system for a motor vehicle engine. For this purpose, a stopcock has been provided at the bottom of the radiator. In order to drain the system, the stopcock is opened and a cap at the top of the radiator is removed to allow air to enter the system braking a vacuum which would otherwise prevent the flow of old spent coolant through the stopcock.

Years ago a service technician draining the radiator simply allowed the spent coolant to flow to a floor drain in the garage from which it entered the municipal sewer system. With increased concerns about harming the environment, such dumping of coolant chemicals, which often contain heavy metals, into a sewer system has been prohibited. Now the service technician must place a pan beneath the stopcock in which to catch the coolant draining from the engine. The technician must then pour the coolant into a suitable container for proper disposal according to environmental protection regulations. The recovered coolant alternatively may be delivered to a recycling center which removes the contaminants and sells the cleansed coolant.

After the spent coolant is removed from the motor vehicle, the cooling system has to be filled with new coolant. This is accomplished by closing the stopcock and pouring the new coolant into the filler neck at the top of the engine that was opened by removal of the radiator cap. When the mechanic is working on the cooling system, often the drained coolant is placed back into the system, if the coolant is relatively fresh and uncontaminated.

Simply pouring the coolant into the filler opening is relatively time consuming and prone to coolant being spilled onto the floor of the garage. In additional, this process may not completely fill the cooling system with new coolant, as air which entered during the draining stage becomes trapped with in cavities in upper sections of the engine during refilling. Therefore, the engine often has to be operated for a period of time to flush the air into the upper part of the radiator from which the air can be replaced later with more coolant added to the system.

SUMMARY OF THE INVENTION

The present invention provides an apparatus for rapidly filling a motor vehicle cooling system with coolant.

That apparatus includes a service cap for attachment to the filler neck of the radiator. The service cap comprises a body, a collar, a resilient sleeve and a compression tube. The body has a passage there through and has external threads on an exterior surface. The collar is threaded onto the external threads of the body and has a first aperture. The resilient sleeve abuts the collar and has a second aperture. A head at one end of the compression tube abuts the sleeve with the compression tube extending through the first and second apertures. Another end of the compression tube is secured in the passage of the body. Movement of the collar on the threads of the body draws the compression tube through the collar and compresses the sleeve against the collar. This action produces outward expansion of the sleeve which seals the cap to the inside of the radiator filler neck.

In the preferred embodiment of the present invention, a valve is connected to the passage in the body to control flow of air and coolant through the passage. A pressure gauge also can be connected to the passage in the body.

The present cap is used to evacuate air from the cooling system by a vacuum source connected to the valve. The vacuum source can constitute a venturi assembly with a suction port connected to the valve, a fluid inlet and a fluid outlet. A muffler may be connected to the fluid outlet. After the evacuation of air, a source of coolant is connected to the valve with the coolant being drawn into the cooling system by the previously created vacuum.

DETAILED DESCRIPTION OF THE INVENTION

Figure 1:
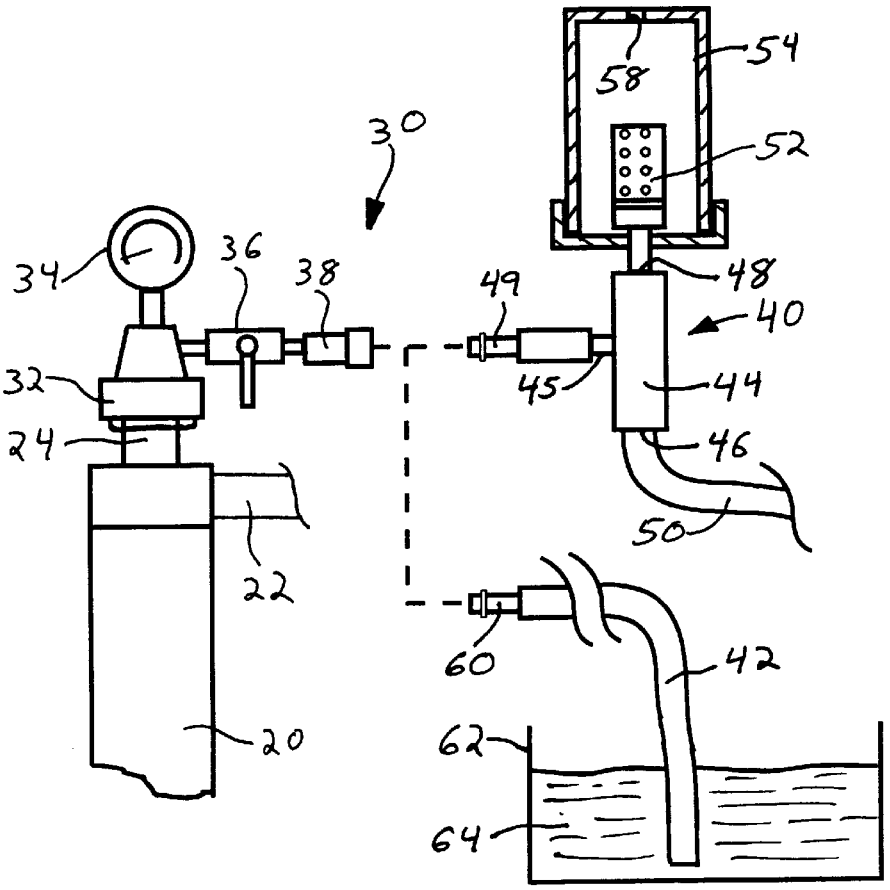
FIG. 1 illustrates an engine coolant replacement apparatus according to the present invention.

With initial reference to FIG. 1, a motor vehicle has a cooling system which includes a radiator 20 with an upper radiator hose 22. The radiator 20 contains a conventional coolant fluid made up of a mixture of water and additives, such as propylene glycol. Periodic maintenance requires that the coolant be drained from the motor vehicle and replaced with new coolant. For that purpose the radiator 20 has a neck 24 at the top through which coolant can be added. When the motor vehicle is operating the neck 24 of the radiator 20 is closed by an air tight cap (not shown). The standard radiator cap has a spring-loaded pressure relief valve that enables excessive coolant to flow to and from a recovery tank (not shown).

Periodic maintenance procedures employ an apparatus 30 for testing and filling the cooling system with the coolant. That apparatus comprises a service cap 32 that replaces the standard cap on the filler neck 24 of the radiator 20 during coolant replacement. Unlike the standard radiator cap, service cap 32 does not have a spring-loaded pressure relief valve.

Figure 2:
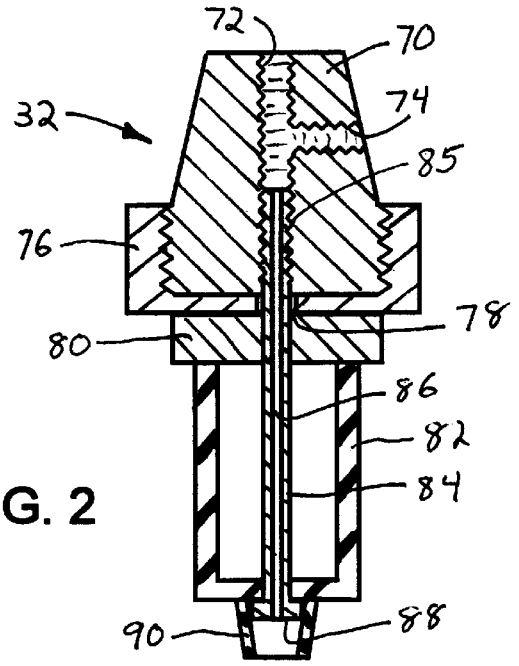
FIG. 2 is a cross sectional view through part of the apparatus in FIG. 1.

With reference to FIG. 2 the service cap 32 has a cylindrical body 70 with a threaded central aperture 72 extending there through and a transverse aperture 74 extends from on side to the central aperture. The lower external circumferential surface of the body 70 is threaded to fit into a threaded collar 76, which has an aperture 78 that is aligned with the central aperture 72. A brass thrust washer 80 abuts the collar 76 and a cup-like, tubular rubber sleeve 82 abuts the washer 80. A compression tube 84 with a longitudinal aperture 86 extends through the sleeve 82, washer 80, collar 76 and has one end 85 threaded into the central aperture 72 of body 70. The compression tube 84 has a head 88 at the opposite end that contacts the end of the rubber sleeve 82 that is remote from the washer 80. A small nipple 90 projects from the sleeve 82 around the head 88 of compression tube 84.

When the service cap 32 is applied to the radiator 20, the rubber sleeve 82 slides into the radiator filler neck 24. While holding the cap body 70 stationary, a service technician rotates the collar 76 to unthread the collar from the body. This action pulls the compression tube 84 through the collar 76 compressing the rubber sleeve 82 between the collar 76 and the compression tube head 88. This causes the sleeve 82 to expand outward against the inner wall of the filler neck 24. The resiliency of the sleeve 82 provides an air tight seal with the filler neck 24.

Referring again to FIG. 1, the service cap 32 has a pressure gauge 34 attached thereto, which indicates the pressure within the radiator 20 when the service cap is sealed onto the neck 24. A fitting is inserted into the transverse aperture 74 of the service cap 32 and a manual valve 36 is connected to the fitting thereby providing a closeable fluid passage into the radiator. A standard quick release female hose coupling 38 is attached to the end of the valve 36 that is remote from the service cap 32.

Either a vacuum source 40 or a coolant supply hose 42 may be connected to the quick release female hose coupling 38. The vacuum source 40 comprises a venturi assembly 44 having a suction port 45, a fluid inlet 46 and a fluid outlet 48. A first quick release male hose coupling 49 is connected to the venturi suction port 45 so that the vacuum source can be attached to the assembly on the radiator 20. The fluid inlet 46 is coupled to a hose 50 from a compressed air supply, such as an air compressor and tank of the type commonly found in motor vehicle repair garages. A filter may be placed between the hose 50 and the venturi's fluid inlet 46 to remove any particles in the compressed air which could adversely affect the operation of the venturi.

The fluid outlet 48 of the venturi assembly 44 is connected to a sound deadening muffler 52. The muffler 52 is surrounded by an enclosure 54 with an opening 58 at a remote end. During operation of the apparatus 30, should any liquid coolant be drawn through the venturi 44 and the muffler 52, the enclosure 54 prevents a liquid stream from being sprayed into the environment of the apparatus.

The coolant supply hose 42 has a second quick release male hose coupling 60. The other end of the coolant supply hose 42 is placed within a supply of coolant. For example as shown in FIG. 1, this end of the hose 42 is within a conventional drain pan 62 that was used to catch the coolant 64 which was drained from the radiator 20. Alternatively, the remote end of the hose 42 could be placed into a container of new coolant.

The old coolant is removed from the radiator 20 by conventional methods. For example, a stopcock (not shown) at the bottom of the radiator 20 is opened and the standard radiator cap is removed from the radiator filler neck 24 to allow air to enter the system braking a vacuum which would otherwise prevent the flow of old spent coolant through the stopcock. After all of the coolant has drained from the cooling system, the stopcock is closed.

Then the service cap 32 is tightened onto the filler neck 24 and the vacuum source is attached to the female hose coupling 38. The valve 36 is opened and the air supply hose is connected to a source of compressed air 50. The air flows through the venturi assembly 44 from the fluid inlet 46 to the fluid outlet 48. That air flow creates a negative pressure at the suction port 45. That negative pressure draws air from the cooling system through the service cap 32, valve 36 and couplings 38 and 49. Eventually substantially all of the air is evacuated from the cooling system as indicated by the pressure reading on gauge 34. At that time the valve 36 is closed.

The technician then monitors the pressure gauge 34 to observe whether the pressure changes during a period of a few minutes. If the cooling system is properly sealed, the pressure should not change, that is the vacuum produced by the suction from the venturi assembly 40 should be maintained. When that occurs the technician knows that the repairs resulted in a properly sealed cooling system.

Then the vacuum source 40 is removed from the female coupling 38 and the coolant supply hose 42 is attached in its place. With the other end of the supply hose 42 submerged in the coolant 64, the valve 36 is opened. The partial vacuum within the radiator 20 and the rest of the cooling system draws the coolant 64 into the radiator. The technician ensures that there is more coolant 64 in the pan 62 than is need to completely fill the cooling system. Eventually the technician will observe that additional coolant is not being drawn from the pan 62 which indicates that the cooling system is full. Because substantially all the air was removed from the cooling system before adding the coolant, there were no air pockets that could otherwise prevent the coolant from filling the system completely.

At this time the service cap 32 can be removed from the filler neck 24 of the radiator 20 and the standard cap attached thereto completing the filling process.

I claim:

1. A service cap for attaching an apparatus for adding coolant to a cooling system to a filler neck of a radiator, said service cap comprising:

a body having a passage there through and having external threads;

a collar threaded onto the external threads of the body and having a first aperture;

a resilient sleeve abutting the collar and having a second aperture; and a compression tube having a head at a first end which abuts the sleeve, the compression tube extending through the first aperture and the second aperture and being secured in the passage of the body;

wherein movement of the collar on the thread of the body draws the compression tube through the collar and compresses the sleeve against the collar resulting in outward expansion of the sleeve.

2. The service cap as recited in claim 1 further comprising a valve connected to the passage in the body.

3. The service cap as recited in claim 1 further comprising a pressure gauge connected to the passage in the body.

4. An apparatus for adding coolant to a cooling system of a vehicle having a radiator with a filler neck, said apparatus comprising:

a service cap for attachment to the filler neck of the radiator, the service cap including a body, a collar, a resilient sleeve and a compression tube, the body having a passage there through and having external threads, the collar threaded onto the external threads of the body and having a first aperture, the resilient sleeve abutting the collar and having a second aperture, the compression tube has a head at a first end which abuts the sleeve, the compression tube extending through the first aperture and the second aperture and has another end secured in the passage of the body, wherein movement of the collar on the thread of the body draws the compression tube through the collar and compresses the sleeve against the collar resulting in outward expansion of the sleeve; and a valve connected to the passage in the body.

5. The apparatus as recited in claim 4 further comprising a pressure gauge connected to the passage in the body.

6. The apparatus as recited in claim 4 further comprising a vacuum source connected to the valve.

7. The apparatus as recited in claim 4 further comprising a venturi assembly having a suction port connected to the valve, a fluid inlet and a fluid outlet.

8. The apparatus as recited in claim 7 further comprising a muffler connected to the fluid outlet.

9. The apparatus as recited in claim 4 further comprising a source of coolant connected to the valve.

* * * * *